US008022908B2

(12) United States Patent
Mizukoshi et al.

(10) Patent No.: US 8,022,908 B2
(45) Date of Patent: Sep. 20, 2011

(54) DISPLAY APPARATUS

(75) Inventors: Seiichi Mizukoshi, Kanagawa (JP); Makoto Kohno, Kanagawa (JP); Kouichi Onomura, Yokohama (JP)

(73) Assignee: Global OLED Technology LLC, Herndon, VA (US)

( * ) Notice: Subject to any disclaimer, the term of this patent is extended or adjusted under 35 U.S.C. 154(b) by 731 days.

(21) Appl. No.: 11/685,225

(22) Filed: Mar. 13, 2007

(65) Prior Publication Data

US 2007/0273701 A1 Nov. 29, 2007

(30) Foreign Application Priority Data

Apr. 5, 2006 (JP) ..... 2006-104120

(51) Int. Cl.
*G09G 3/30* (2006.01)

(52) U.S. Cl. ..... 345/77; 345/690; 345/76

(58) Field of Classification Search ..... 345/76–104, 345/204–215, 690–699
See application file for complete search history.

(56) References Cited

U.S. PATENT DOCUMENTS 4,975,691 A * 12/1990 Lee ..... 345/79
5,303,068 A * 4/1994 Udagawa et al. ..... 358/444
5,537,493 A * 7/1996 Wilkinson ..... 382/240
5,537,496 A * 7/1996 Katayama ..... 382/272
5,621,466 A * 4/1997 Miyane et al. ..... 375/240.2
5,708,511 A * 1/1998 Gandhi et al. ..... 382/239
5,995,751 A * 11/1999 Kosugi et al. ..... 717/100
6,232,937 B1 * 5/2001 Jacobsen et al. ..... 345/87
6,373,412 B1 * 4/2002 Mitchell et al. ..... 341/65
6,563,439 B1 * 5/2003 Acharya et al. ..... 341/65
7,834,825 B2 * 11/2010 Mizukoshi et al. ..... 345/77
7,859,492 B2 * 12/2010 Kohno ..... 345/77
2004/0150592 A1 * 8/2004 Mizukoshi et al. ..... 345/76
2005/0169450 A1 * 8/2005 Blin et al. ..... 379/202.01
2005/0169540 A1 * 8/2005 Funakubo et al. ..... 382/232

FOREIGN PATENT DOCUMENTS

JP 11-282420 10/1999
WO 2005/101360 10/2005

* cited by examiner

*Primary Examiner* — Alexander Eisen
*Assistant Examiner* — Patrick F Marinelli
(74) *Attorney, Agent, or Firm* — Morgan, Lewis & Bockius LLP

(57) ABSTRACT

After a look-up table applies γ correction to each of R, G, and B signals, a multiplier multiplies a γ corrected signal by a gain. An adder adds an offset to an output of the multiplier and supplies a resultant gain/offset corrected signal to a display panel. Memories store entropy coded correction data, which can be expanded by corresponding expansion circuits and supplied to the multiplier and the adder, respectively.

10 Claims, 18 Drawing Sheets

INPUT IMAGE

DISPLAY IMAGE

INPUT IMAGE

DISPLAY IMAGE

DISPLAY APPARATUS

CROSS-REFERENCE TO RELATED APPLICATION

This application claims priority to Japanese Patent Application No. 2006-104120 filed Apr. 5, 2006 which is incorporated herein by reference in its entirety.

FIELD OF THE INVENTION

The present invention relates to a display apparatus that can control the display of pixels constituting a screen display based on input data. More particularly, the invention relates to a correction technique that can eliminate brightness irregularities appearing among the pixels constituting the screen display.

BACKGROUND OF THE INVENTION

The liquid crystal display of an active matrix type includes numerous thin film transistors (TFTs) that can control the display of pixels constituting a flat display panel. The organic EL display includes organic light emitting diodes (OLED), i.e., organic EL elements, and can be arranged as a flat display panel of an active matrix type.

FIG. 20 shows an example of a circuit arrangement of one pixel (i.e., a pixel circuit) in an active organic EL display apparatus. A gate line (Gate) extending in the horizontal direction can supply a high-level gate signal to a selection TFT 2. A data line (Data) extending in the vertical direction can supply a data signal having a voltage level corresponding to required display brightness. When the data signal is applied to the data line under the condition that the selection TFT 2 is turned on, a holding capacitor C can store the data signal. A driver TFT 1 can produce driving current corresponding to the data signal which is supplied to an organic EL element 3. The organic EL element 3 can emit light corresponding to the data signal.

The light emission of an organic EL element is substantially proportional to its current. In general, a predetermined voltage (Vth) is applied between the gate terminal of the driver TFT 1 and a PVdd terminal, so that the drain current starts flowing in the vicinity of the black level of an image. Furthermore, the amplitude of an image signal can be determined, so that predetermined brightness can be obtained in the vicinity of the white level.

FIG. 21 is a graph showing the prior art relationship between an input signal voltage of the driver TFT 1 (i.e., gate-source voltage Vgs=a difference between the voltage of data line "Data" and a power source voltage PVdd) and a current icv flowing in the organic EL element 3 (i.e., current corresponding to brightness). The gradation of the organic EL element 3 is adjustable with an appropriately determined data signal, so that the voltage Vth can define a black level voltage and the voltage Vw can define a white level voltage.

The organic EL display apparatus can be configured into a display panel including numerous pixels disposed in a matrix pattern. Such a display panel tends to be prone to manufacturing errors or deterioration with age, and the threshold voltage (Vth) of a driver TFT or the gradient (gm) of voltage-current (V-I) characteristics may change undesirably. As a result, the pixels constituting a display panel will cause brightness irregularities.

To correct the brightness irregularities, as shown in FIG. 1, the threshold voltage (Vth) can be corrected by adding an appropriate value to the driving signal of each pixel (referred to as "offset correction"), or the gradient (gm) can be corrected by multiplying by an appropriate value (referred to as "gain correction").

For example, an arrangement shown in FIG. 2 can be used to correct the brightness irregularities. When the average characteristic of pixels aligned in a horizontal line n (refer to curve (b)) is different from the average characteristic of all pixels (refer to curve (a)), brightness irregularities can be corrected by changing offset/gain of the horizontal line n.

Similar correction methods are, for example, disclosed in Japanese Patent Application Laid-open No. Hei 11-282420, U.S. Patent Application Publication 2004/0150592 A1, and WO 2005/101360 A1.

If the above-described correction is required for all pixels, correction data must be prepared for all pixels correspondingly. In other words, a large capacity of memory will be required to store correction data necessary for the pixels constituting the panel. The capacity and cost of a required memory will increase in accordance with the number of pixels constituting the panel. The required memory size will further increase if enlarging the bit width of a correction memory is required to correct a wide range of irregularities, correspondingly.

SUMMARY OF THE INVENTION

The present invention provides a technique capable of minimizing the size of a memory that stores correction data used for correcting brightness irregularities appearing among display elements.

At least one embodiment of the present invention is directed to a display apparatus, including control means for controlling the display of pixels constituting a screen display based on input data; a correction memory storing correction data for eliminating unevenness in brightness among respective pixels; and correcting means for correcting brightness irregularities based on the data stored in the memory and the input data. The correction data stored in the correction memory are entropy coded data, and the correcting means being configured to expand the entropy coded data and calculate correction values based on expanded data and the input data.

According to the display apparatus of the present invention, it is preferable that the entropy coded data are obtained by Huffman coding.

According to the display apparatus of the present invention, it is preferable that the correction memory stores Huffman tables differentiated for small areas.

According to the display apparatus of the present invention, it is preferable that the Huffman table is determined based on display characteristics of each pixel in the display apparatus.

According to the display apparatus of the present invention, it is preferable that the correction memory stores brightness irregularity correction data for each small area consisting of a plurality of pixels on the screen display, and the display is controlled by combining brightness irregularity correction of the small area and correction based on the entropy coded data stored in the correction memory.

According to the display apparatus of the present invention, it is preferable that a buffer memory capable of holding input data of two horizontal lines is provided independent of the correction memory. The input data are successively written into the buffer memory, and an image inversed in the lateral direction is displayed by reading the input data from a final pixel to a leading pixel in each line and performing calculations based on readout data and the correction data.

According to the display apparatus of the present invention, it is preferable that the correction memory stores correction data in such a manner that a correction data storage place of a leading pixel of each horizontal line can be identified. The correcting means reverses a vertical scanning direction of a display panel, successively reads and expands compressed correction data from a final horizontal line to a leading horizontal line of the correction memory, and calculates the correction values based on the expanded data and the input data, thereby displaying an image inversed in the vertical direction.

According to the display apparatus of the present invention, it is preferable that the correction memory stores correction data in such a manner that a correction data storage place for a leading pixel of each horizontal line can be identified. The correcting means reverses a vertical scanning direction of a display panel, successively reads and expands compressed correction data from a final horizontal line to a leading horizontal line of the correction memory, and calculates the correction values based on the expanded data and the input data of a corresponding pixel read out of the buffer memory, thereby displaying an image inversed in both the lateral and vertical directions.

According to the display apparatus of the present invention, it is preferable that each pixel has an organic EL element having light-emitting capability.

With the present invention employing the entropy coding technique, the memory capacity required for correcting brightness irregularities can be reduced. Furthermore, the display apparatus of the present invention can correct a wide range of irregularities unless the compression data exceed a maximum memory capacity.

BRIEF DESCRIPTION OF THE DRAWINGS

The accompanying drawings, which are incorporated in and constitute a part of the specification, illustrate an embodiment of the invention and, together with the description, serve to explain the principles of the invention, in which.

DETAILED DESCRIPTION OF THE INVENTION

Hereinafter, embodiments of the present invention will be described with reference to the drawings.

Figure 4:
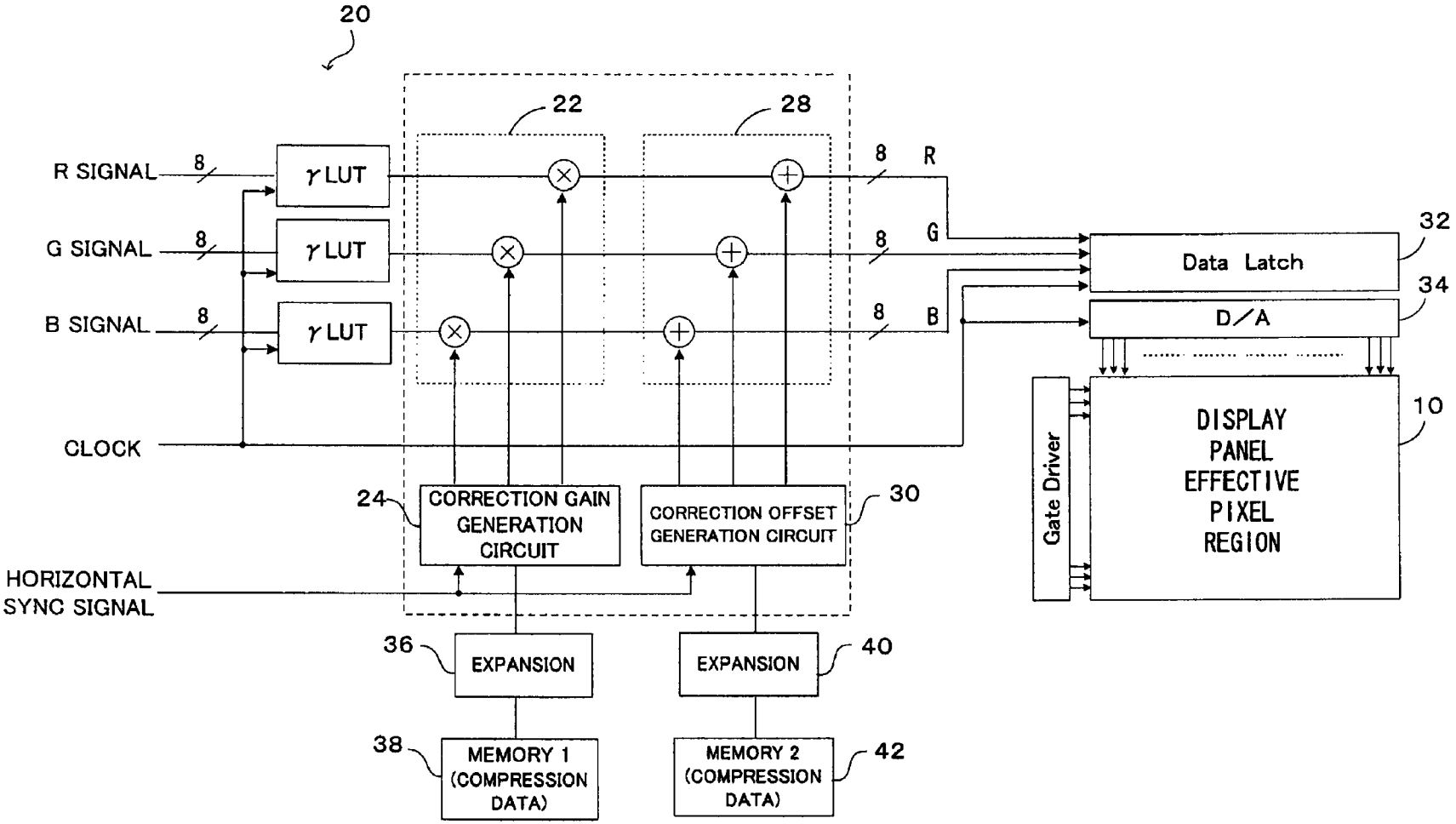
FIG. 4 is a block diagram showing an arrangement of a display apparatus according to an embodiment of the present invention.

FIG. 4 shows an example of an organic EL display apparatus according to the present invention, which can produce corrected brightness data, i.e., analog signals, based on input brightness data and can supply the corrected brightness data to pixels constituting a display panel.

A display panel 10 includes numerous R, G, and B pixels (i.e., pixels generating R, G, and B colors), and can input R, G, and B brightness signals for the display of R, G, and B colors. For example, the display panel 10 includes the same color of pixels arrayed in the vertical direction. One of R, G, and B data can be supplied to each data line. Each pixel can emit light in response to one of R, G, and B data supplied from a corresponding data line. In the example, R, G, and B signals are 8-bit brightness data.

Figure 1:
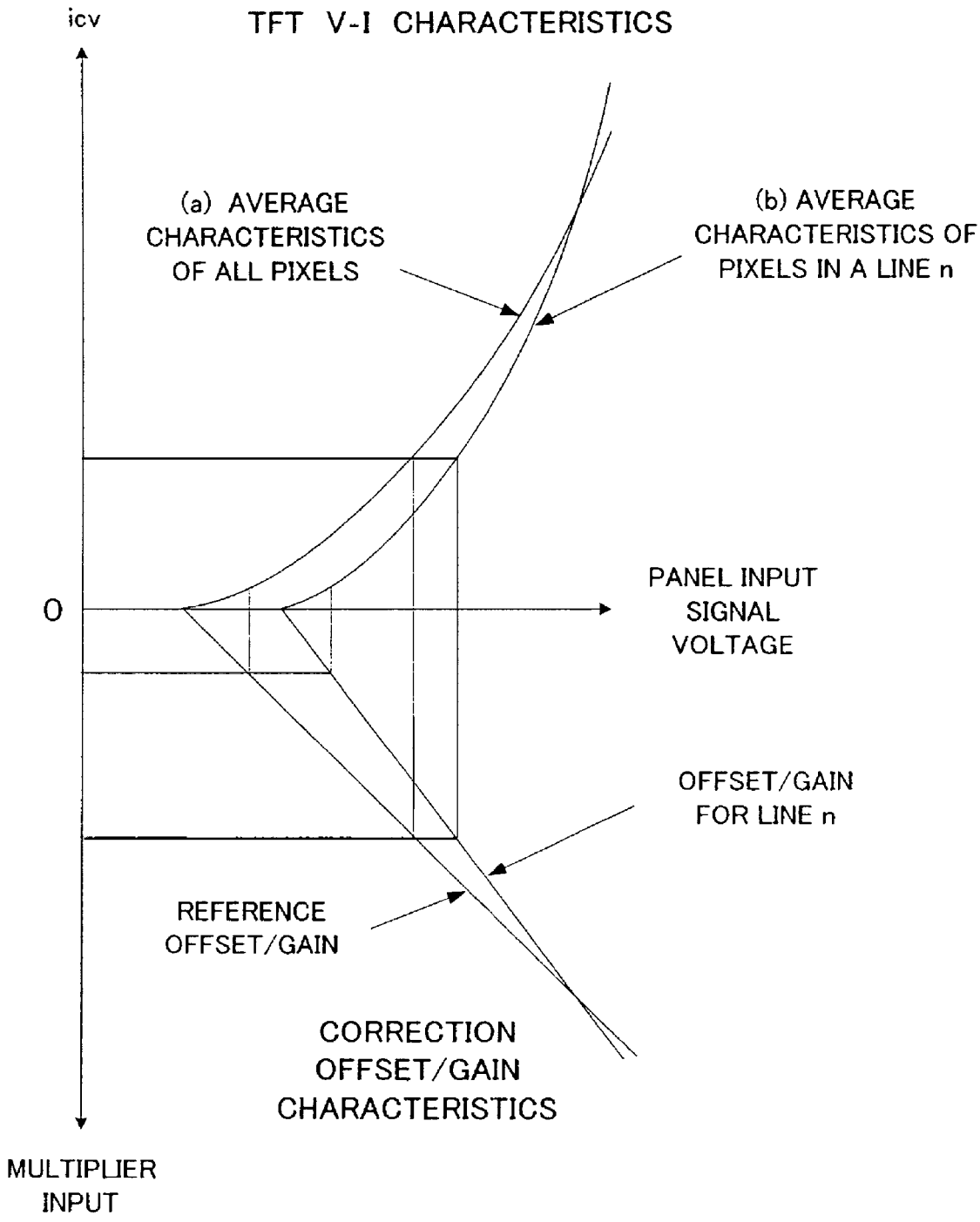
FIG. 1 is a graph showing a conventional correcting method.
Figure 2:
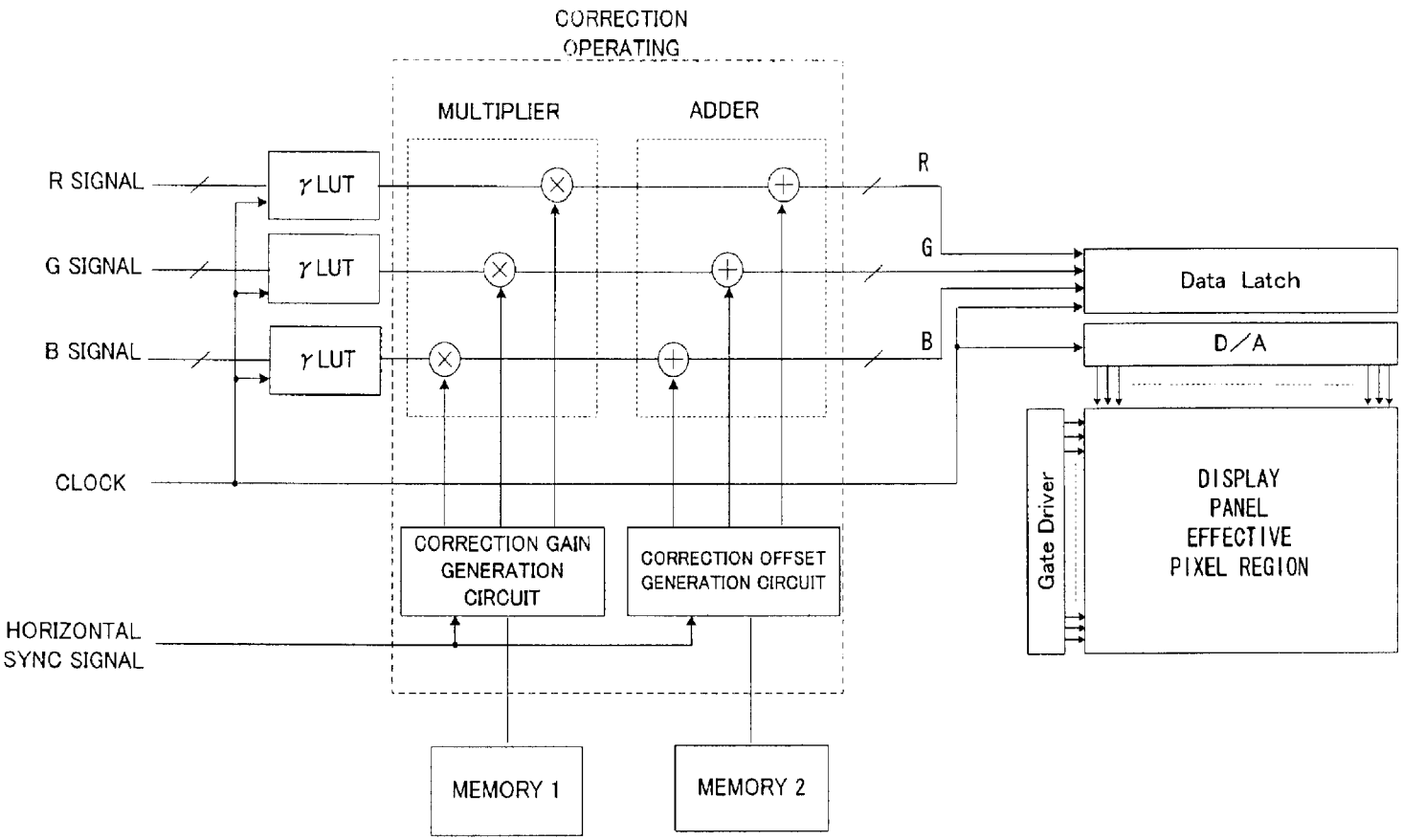
FIG. 2 is a block diagram showing an arrangement of a conventional display apparatus.

The R, G, and B signals can be independently supplied to corresponding R, G, and B look-up tables LUT20. Each of the R, G, and B look-up table LUT20 stores gamma correction data for obtaining a desired relationship (i.e., desired curve) between the light-emitting brightness (i.e., driving current) and the brightness data, with reference to average values of the offset and the gain of the display panel 10. In other words, each look-up table 20 can store correction data for compensating the characteristics (a) shown in FIG. 1.

Instead of using the look-up tables LUT20, the display apparatus can store predetermined equations to calculate conversion values of the brightness data.

Each look-up table LUT20 receives a pixel clock in synchronism with an input signal of each pixel and produces an output in synchronism with the pixel clock.

The R, G, and B look-up tables LUT20 can supply their outputs to corresponding R, G, and B multipliers 22. A correction gain generation circuit 24 can supply gain correction values to the R, G, and B multipliers 22, respectively.

The R, G, and B multipliers 22 can supply their outputs to corresponding R, G, and B adders 28. A correction offset generation circuit 30 can supply offset correction values to the R, G, and B adders 28, respectively.

The R, G, and B adders 28 can supply their outputs to a data latch circuit 32. The data latch circuit 32 can supply latched data to a D/A converter 34. The D/A converter 34 can convert the R, G, and B digital signals into corresponding analog signals, and can supply the converted signals to corresponding data lines of the display panel 10.

Thus, the corrected data signals are supplied via the data lines to pixel positions of respective colors, so that the EL element in each pixel can be driven based on current corresponding to a given data signal.

As described above, in the present embodiment, the look-up table LUT20 compensates the offset and the V-I characteristics of an average driver TFT and performs the gamma correction. The correction gain generation circuit 24 and the correction offset generation circuit 30 generate a correction gain and a correction offset for each pixel positioned in the display panel 10.

Therefore, the display apparatus of the present embodiment not only compensates a deviation AVth of the threshold voltage Vth for the driving transistor (driver TFT) in each pixel but also compensates the V-I characteristics representing the relationship between the gate-source voltage Vgs and the drain current (i.e., driving current of the organic EL). Thus, the driving current corresponding to the brightness data can be appropriately supplied to the organic EL element.

In the present embodiment, the correction gain generation circuit 24 is connected via an expansion circuit 36 to a memory 38. The correction gain generation circuit 24 has a fundamental function of generating a gain correction value adaptive to the input brightness data with reference to a pixel position on the screen. To this end, the correction gain generation circuit 24 reads necessary correction data from the memory 38 and determines the gain correction value. The memory 38 stores entropy coded data. The expansion circuit 36 expands the entropy coded data and supplies expanded correction data to the correction gain generation circuit 24.

Furthermore, the correction offset generation circuit 30 is connected via an expansion circuit 40 to a memory 42. The correction offset generation circuit 30 has a fundamental function of generating an offset correction value adaptive to the input brightness data with reference to a pixel position on the screen.

To this end, the correction offset generation circuit 30 reads necessary correction data from the memory 42 and determines the offset correction value. The memory 42 stores entropy coded data. The expansion circuit 40 expands the entropy coded data and supplies expanded correction data to the correction offset generation circuit 30.

Figure 3B:
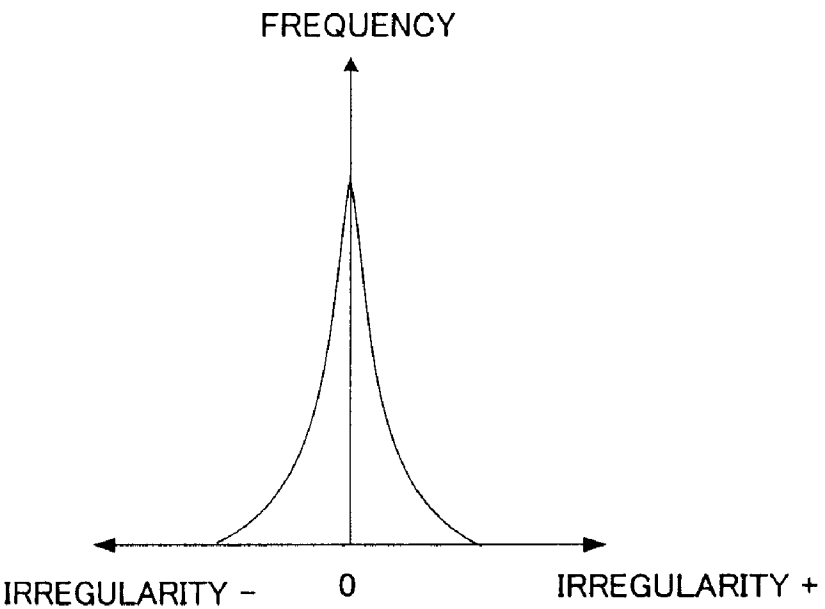
FIG. 3B is a graph showing another example of the distribution of irregularities.
Figure 3A:
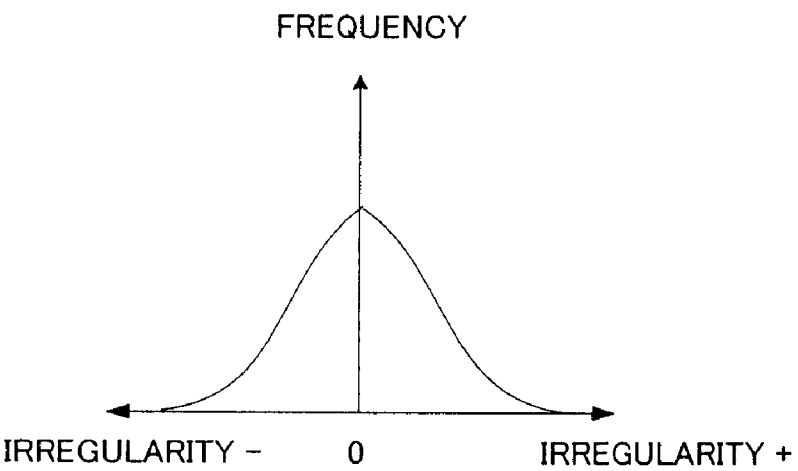
FIG. 3A is a graph showing an example of the distribution of irregularities.

In general, the brightness irregularities are classified into various types according to their causes or sources. For example, the dispersion of correction values can generate irregularities. However, as shown in FIGS. 3A and 3B, an ordinary histogram of correction values has a distribution pattern having a largest value at 0 and other values decreasing according to the absolute value of the irregularities. Hence, the display apparatus of the present embodiment compresses the correction data by entropy coding and stores the entropy coded data (i.e., compressed correction data) in the memories 38 and 42.

When the input R, G, and B signals are displayed on the display panel 10, the expansion circuits 36 and 40 expand the compressed correction data while the calculation for correcting the pixel data is performed.

As one example, the display panel 10 can include 320×240 pixels. The display apparatus performs a simplified correction for correcting only the threshold voltage Vth. It is now assumed that each signal data consists of 6 bits, and the display apparatus can perform correction within the range of ±25% for each signal data. In this case, one pixel requires correction data of 5 bits (−15 to +15) including code bits. Namely, an ordinarily required memory size is 320×240×5=384,000 bits.

The total data amount, required when the Huffman coding is employed, can be obtained by summing up "bit length of Huffman code×frequency" of respective correction values. Table 1 shows one example of the frequency distribution of irregularities and Huffman codes, according to which the total data amount rises up to 251,205 bits. The required memory size is equal to a sum of the above data amount and the size required for a Huffman table.

TABLE 1

| correction value | frequency | Huffman code | code bit length | frequency × code bit length |
|---|---|---|---|---|
| 0 | 21405 | 00 | 2 | 42810 |
| 1 | 10075 | 010 | 3 | 30225 |
| −1 | 9816 | 100 | 3 | 29448 |
| 2 | 7411 | 110 | 3 | 22233 |
| −2 | 6808 | 111 | 3 | 20424 |
| −3 | 5120 | 0110 | 4 | 20480 |
| 3 | 5106 | 1010 | 4 | 20424 |
| −4 | 2992 | 01110 | 5 | 14960 |
| 4 | 2761 | 10110 | 5 | 13805 |
| 5 | 1379 | 011110 | 6 | 8274 |
| −5 | 1262 | 101110 | 6 | 7572 |
| −6 | 955 | 0111110 | 7 | 6685 |
| 6 | 595 | 1011110 | 7 | 4165 |
| 7 | 404 | 01111110 | 8 | 3232 |
| −7 | 226 | 10111110 | 8 | 1808 |
| −8 | 128 | 011111110 | 9 | 1152 |
| 8 | 121 | 101111110 | 9 | 1089 |
| −9 | 97 | 101111111 | 9 | 873 |
| 9 | 63 | 0111111110 | 10 | 630 |
| 10 | 32 | 01111111110 | 11 | 352 |
| −10 | 23 | 011111111110 | 12 | 276 |
| 11 | 12 | 0111111111110 | 13 | 156 |
| −11 | 5 | 01111111111110 | 14 | 70 |
| 12 | 2 | 011111111111110 | 15 | 30 |
| −12 | 1 | 0111111111111110 | 16 | 16 |
| 13 | 1 | 0111111111111111 | 16 | 16 |
| −15 | 0 | — | — | — |
| −14 | 0 | — | — | — |
| −13 | 0 | — | — | — |
| 14 | 0 | — | — | — |
| 15 | 0 | — | — | — |
| | | total | | 251205 |

Furthermore, unless the compression data exceed a maximum memory capacity, the display apparatus of the present embodiment can correct a wide range of irregularities. In other words, according to the example, the conventional method cannot completely correct irregularities, if the irregularities exceed ±25%.

The display apparatus of the present embodiment can obtain the Huffman codes according to the following general procedure, including the steps of:

1) arraying a total of n correction values (symbols) in order of frequency;

2) selecting two symbols that have the lowest and second lowest frequencies, allocating the code 1 or 0 to the selected symbols, and integrating them as a single symbol having a summed-up frequency of two original symbols;

3) arraying a total of (n−1) symbols resulting from the above processing in order of frequency, selecting two symbols having the lowest and second lowest frequencies, and allocating the code 1 or 0 to the selected symbols; and 4) repeating the above-described processing until the symbol number reduces to 1, and reading the codes allocated in the process of the above processing in the inverse order to obtain a code of a corresponding symbol.

The Huffman table obtained by the above-described procedure can be stored together with compressed correction data in the memory of the display apparatus, and can be used in the decoding processing.

Figure 5:
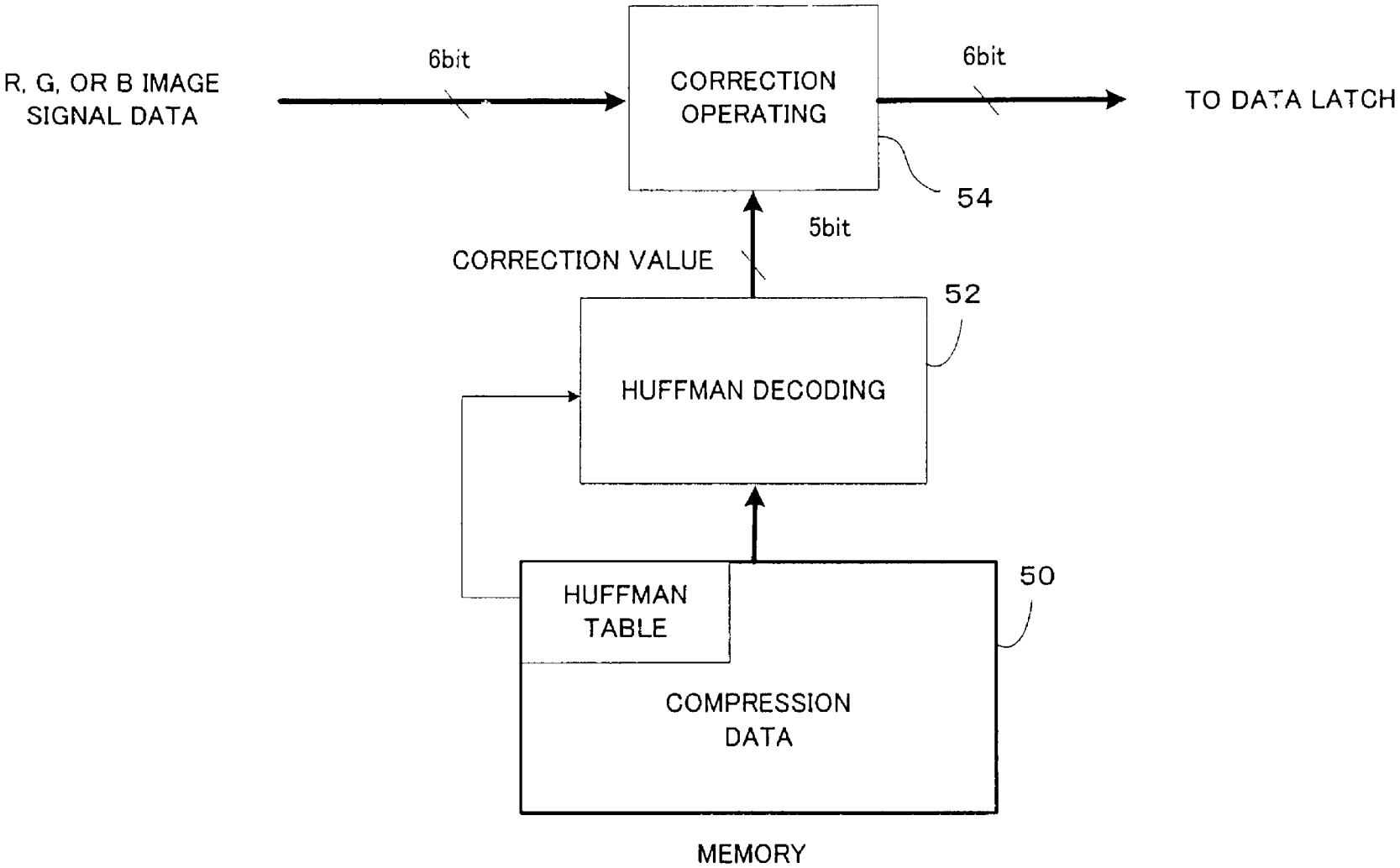
FIG. 5 is a block diagram showing an example of a circuit arrangement for correcting image signals.

FIG. 5 shows an arrangement for calculating correction values, including a memory 50, a Huffman decoding section 52, and a correction operating section 54. The memory 50 can store a Huffman table and compression data. The Huffman decoding section 52 can read, from the memory 50, correction data adaptive to the input data and produce Huffman decoded correction values. The correction operating section 54 can receive the Huffman decoded correction values from the Huffman decoding section 52. The correction operating section 54 is functionally equivalent to the multiplier 22 or the adder 28 shown in FIG. 4. The memory 50 is functionally equivalent to the memory 38 or 42 shown in FIG. 4. The Huffman decoding section 52 is functionally equivalent to the expansion circuit 36 or 40 shown in FIG. 4.

Figure 6:
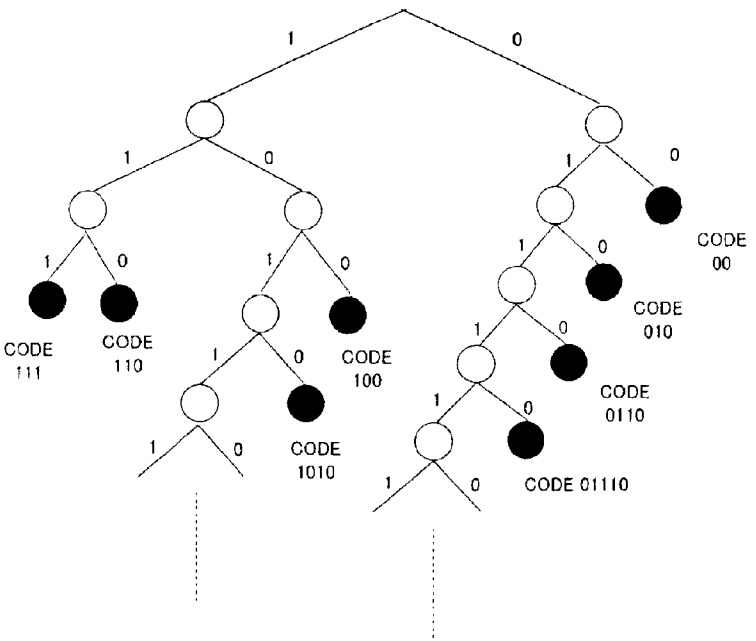
FIG. 6 is a view showing a Huffman tree.

FIG. 6 is a Huffman tree showing part of the codes shown in the table 1. Compared to using the table 1, storing a Huffman tree in a memory as described below is convenient because the data can be directly used in the decoding processing.

Figure 7:
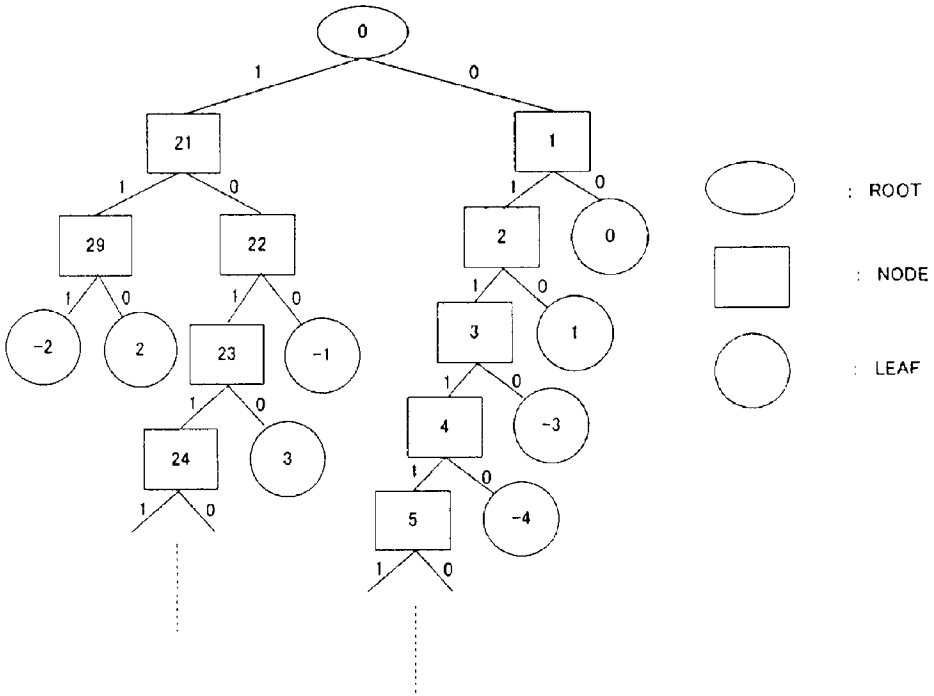
FIG. 7 is a view showing a Huffman tree.

First, an arbitrary number is allocated to each node of the tree as shown in FIG. 7, with an exception that 0 is allocated to the root. For each node, the information of the side "1" (i.e., the side numbered with 1) is stored in bits 11 through 6 and the information of the side "0" (i.e., the side numbered with 0) is stored in bits 5 through 0 in a corresponding address of the memory.

When a leaf is attached to the side "1", 0 is stored in bit 11 and the data is stored in bits 10 through 6. When a node is attached to the side "1", 1 is stored in bit 11 and the number of node is stored in bits 10 through 6.

Similarly, when a leaf is attached to the side "0", 0 is stored in bit 5 and the data is stored in bits 4 through 0. When a node is attached to the side "0", 1 is stored in bit 5 and the number of nodes is stored in bits 4 through 0.

In this case, the data is an integer of 5 bits attached with a code, and the number of nodes is an integer of 5 bits attached with no code.

Table 2 shows the contents of a memory storing Huffman codes allocated as shown in Table 1.

TABLE 2

| Address | Bit 11 | Bit 10~6 | Bit 5 | Bit 4~0 |
|---|---|---|---|---|
| 0 | 1 | 16 | 1 | 1 |
| 1 | 1 | 2 | 0 | 0 |
| 2 | 1 | 3 | 0 | 1 |
| 3 | 1 | 4 | 0 | −3 |
| 4 | 1 | 5 | 0 | −4 |
| 5 | 1 | 6 | 0 | 5 |
| 6 | 1 | 7 | 0 | −6 |
| 7 | 1 | 8 | 0 | 7 |
| 8 | 1 | 9 | 0 | −8 |
| 9 | 1 | 10 | 0 | 9 |
| 10 | 1 | 11 | 0 | 10 |
| 11 | 1 | 12 | 0 | −10 |
| 12 | 1 | 13 | 0 | 11 |
| 13 | 1 | 14 | 0 | −11 |
| 14 | 1 | 15 | 0 | 12 |
| 15 | 0 | 13 | 0 | −12 |
| 16 | 1 | 24 | 1 | 17 |
| 17 | 1 | 18 | 0 | −1 |
| 18 | 1 | 19 | 0 | 3 |
| 19 | 1 | 20 | 0 | 4 |
| 20 | 1 | 21 | 0 | −5 |
| 21 | 1 | 22 | 0 | 6 |
| 22 | 1 | 23 | 0 | −7 |

TABLE 2-continued

| Address | Bit 11 | Bit 10~6 | Bit 5 | Bit 4~0 |
|---|---|---|---|---|
| 23 | 0 | −9 | 0 | 8 |
| 24 | 0 | −2 | 0 | 2 |

When the allocation of codes based on the table 2 is performed, the expansion procedure performed according to the present embodiment includes the following steps of:

0) designating 0 as a read address of the memory;

1) reading memory data;

2) reading 1 bit of compression data;

3) fetching upper 6 bits of the data read from the memory if the readout compression data is 1, and lower 6 bits if the readout compression data is 0;

4) designating lower 5 bits as a read address of the memory if the MSB of a fetched data is 1, and outputting the lower 5 bits as an expansion result and designating 0 as a read address of SRAM if the MSB is 0; and 5) repeating the above steps 1) through 4) until the compression data is fully processed (i.e., until the processing of the final line is completed).

In this case, the memory capacity required for storing the data of a Huffman tree is $2(n+1)\times(2^n-1)$ bits when the correction value is n bits, because the number of nodes is $2^n-1$ and the number of leaves is $2^n$. When the correction value is 5 bits as shown in the example, the required memory capacity is 372 bits.

In the present example, the Huffman table is prepared for each panel, so that a suitable table can be used for expansion in each panel. However, a common Huffman table can be used for many panels if the frequency distribution of irregularity correction values is similar among the panels.

Table 3 shows one example of a fixed Huffman table.

TABLE 3

| correction value | code |
|---|---|
| −15 | 10111111111 |
| −14 | 10111111110 |
| −13 | 10111111101 |
| −12 | 10111111100 |
| −11 | 10111111011 |
| −10 | 10111111010 |
| −9 | 1011111100 |
| −8 | 101111101 |
| −7 | 101111100 |
| −6 | 10111101 |
| −5 | 10111100 |
| −4 | 101110 |
| −3 | 10110 |
| −2 | 1010 |
| −1 | 100 |
| 0 | 0 |
| 1 | 110 |
| 2 | 1110 |
| 3 | 11110 |
| 4 | 111110 |
| 5 | 11111100 |
| 6 | 11111101 |
| 7 | 111111100 |
| 8 | 111111101 |
| 9 | 1111111100 |
| 10 | 11111111010 |
| 11 | 11111111011 |
| 12 | 11111111100 |
| 13 | 11111111101 |
| 14 | 11111111110 |
| 15 | 11111111111 |

Furthermore, if the irregularities vary greatly depending on the position on the panel, the Huffman table can be differentiated for each small area consisting of a predetermined number of horizontal lines. In this case, the required memory amount with the Huffman table can be reduced when the pixel number in a small area relative to the amount of Huffman codes (i.e., the size of Huffman table) is sufficiently large.

Furthermore, the entropy coding can be effectively performed by combining the processing of the above-described embodiment with the irregularity correction applied to each small area and the correction applied to each pixel (refer to the above-described conventional correction methods).

Figures 8A, 8B:
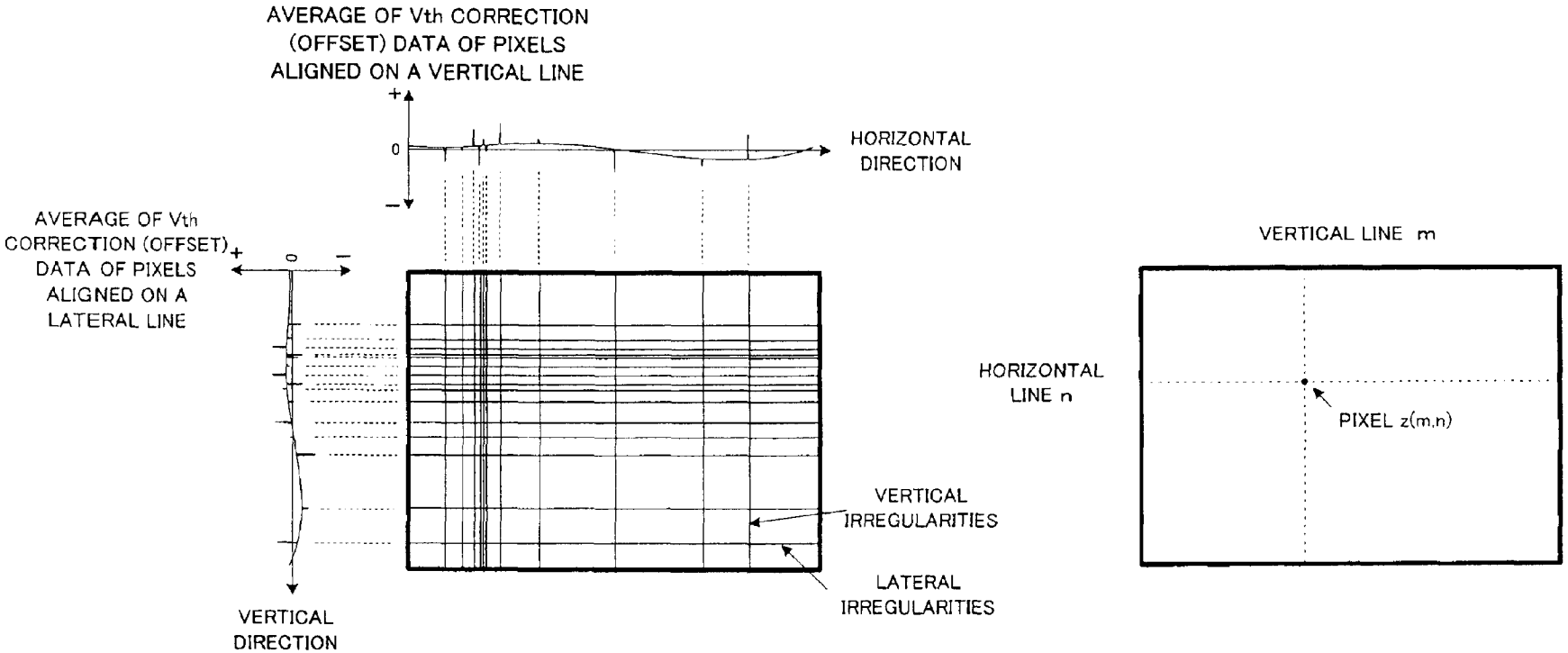
FIG. 8A is a view showing vertical and lateral irregular streaks.
FIG. 8B is a view showing a pixel position.

As an example, the correction of the threshold voltage Vth can be performed for a panel having vertical and lateral irregular streaks as shown in FIG. 8A. In practice, the streaks may be very thin and weak, or the number of streaks may be very large. In this case, the correction processing includes a step of obtaining correction data for the vertical and lateral streaks before or when the panel is delivered.

Furthermore, the correction processing includes a step of obtaining correction data of each pixel, a step of performing calculations based on the correction data of each pixel and the correction data of the vertical and lateral streaks, and a step of storing both the compression data (resulting from the calculation) and the correction data of the vertical and lateral streaks in a memory of the display apparatus. In this case, instead of performing the calculations, it is possible to obtain the correction data of each pixel after the correction is performed based on the correction data of the vertical and lateral streaks. When an image is displayed on the panel, an inverse calculation is performed after accomplishing expansion of the pixel data and the correction of each pixel data is performed.

Figure 9:
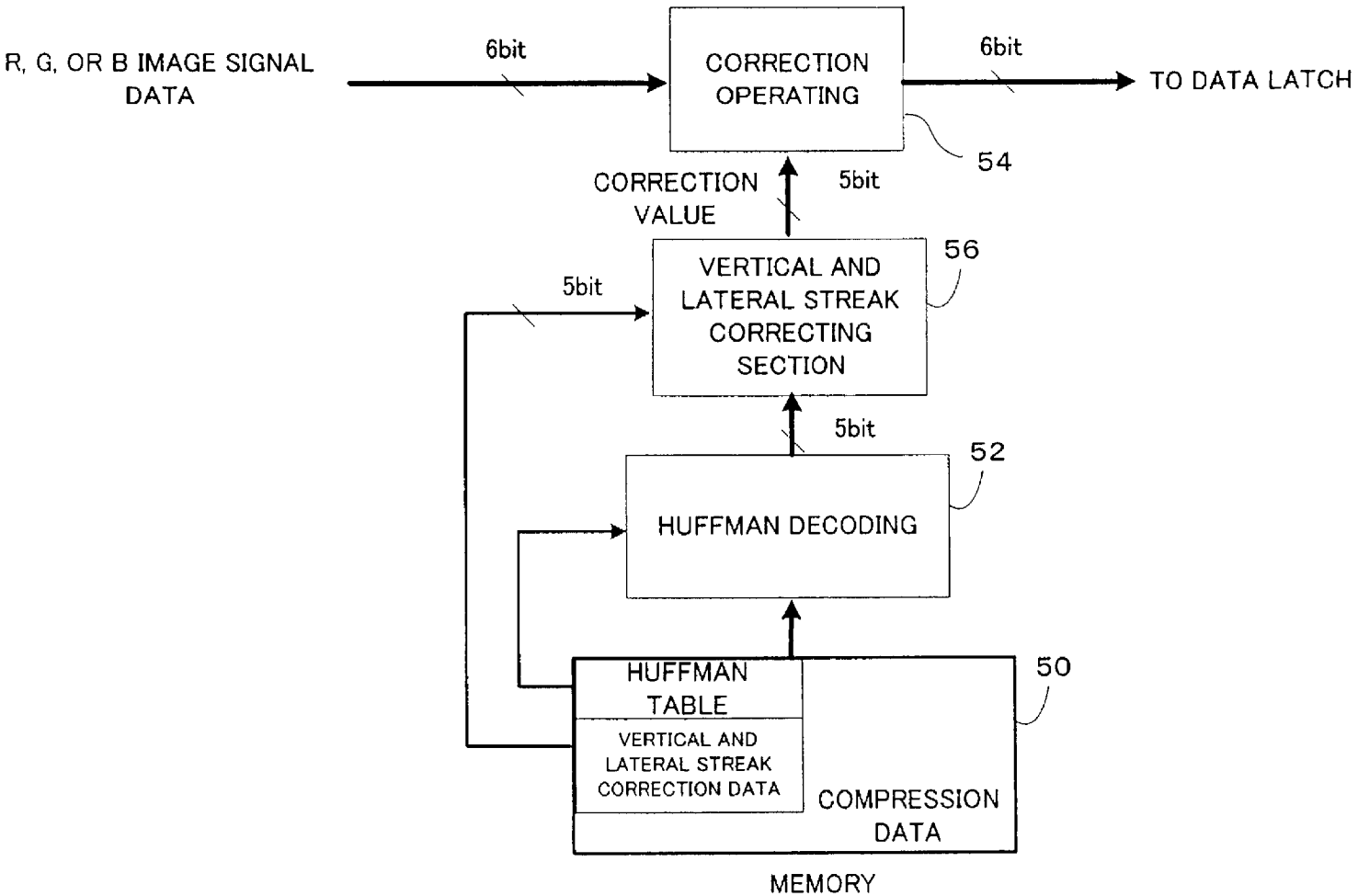
FIG. 9 is a block diagram showing another example of a circuit arrangement for correcting image signals.

FIG. 9 shows an arrangement for the above-described correction, including a memory 50, a Huffman decoding section 52, a correction operating section 54, and a vertical and lateral streak correcting section 56. The memory 50 can store correction data of vertical and lateral streaks in addition to the Huffman table and the compression data. The Huffman decoding section 52 can perform the Huffman decoding processing based on the Huffman table and the compression data, and can supply obtained correction data to the vertical and lateral streak correcting section 56. The vertical and lateral streak correcting section 56 can apply additional correction processing to the correction data supplied from the Huffman decoding section 52 based on the correction data of the vertical and lateral streaks supplied from the memory 50. The correction operating section 54 can receive additionally corrected correction values from the vertical and lateral streak correcting section 56.

The following equations define non-compressed data of a pixel z(m, n) shown in FIG. 8B.

$$\text{Offset data: } Zo(m,n)=zo(m,n)-xo(m)-yo(n)$$

$$\text{Gain data: } Zg(m,n)=zg(m,n)/(xg(m)\times yg(n))$$

In the above equations, Zo(m, n) represents residual offset correction data of the pixel z positioned at coordinates (m, n) after accomplishing the vertical and lateral streak correction, zo(m, n) represents offset correction data of the pixel z positioned at the coordinates (m, n), xo(m) represents an average of offset correction data obtained from the pixels aligned along a vertical line at a horizontal position m, yo(n) represents an average of offset correction data obtained from the pixel aligned along a horizontal line at a vertical position n, Zg(m, n) represents residual gain correction data of the pixel z positioned at coordinates (m, n) after accomplishing the vertical and lateral streak correction, zg(m, n) represents gain correction data of the pixel z positioned at coordinates (m, n), xg(m) represents an average of gain correction data obtained from the pixels aligned along a vertical line at a horizontal position m, and yg(n) represents an average of gain correction data obtained from the pixels aligned along a horizontal line at a vertical position n.

When an image is displayed, correction values can be obtained by the following equations.

$$\text{Offset correction value: } zo(m,n)=Zo(m,n)+xo(m)+yo(n)$$

$$\text{Gain correction value: } zg(m,n)=Zg(m,n)\times xg(m)\times yg(n)$$

The number of vertical and lateral streak correction values is equal to "a horizontal line number+a vertical line number" with respect to each of the offset and the gain, which is very small compared to the number of correction values for respective pixels. Thus, a required memory amount is very small.

If FIG. 3A shows the histogram of correction values adaptive to respective pixels constituting a panel having many irregular vertical and lateral streaks, the above processing can obtain correction values concentrated in the vicinity of 0 as shown in FIG. 3B. Accordingly, the data amount after compression can be reduced.

Figure 10:
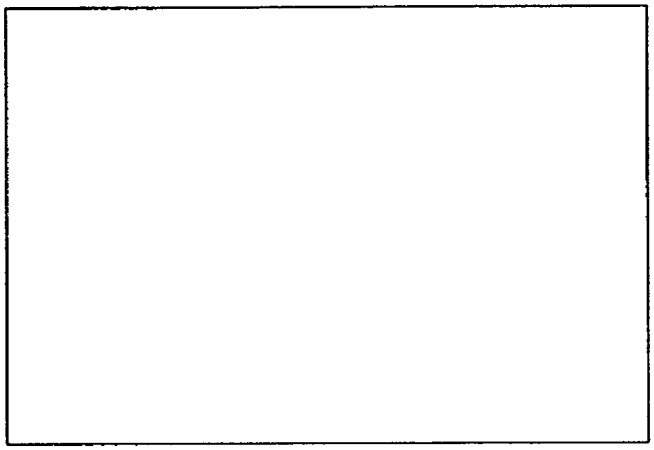
FIG. 10 is a view showing an example of irregularities appearing on a screen.

Performing the irregularity correction applied to vertical and lateral streaks can simultaneously improve the irregularities shown in FIG. 10 where the brightness gradually varies obliquely in the entire screen.

Figure 11A:
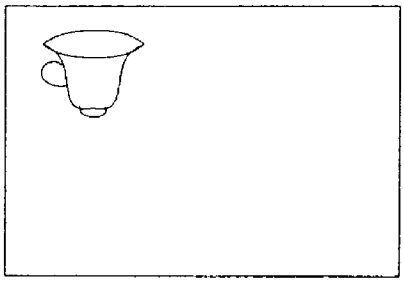
FIG. 11A is a view showing an example of an input image.
Figure 11B:
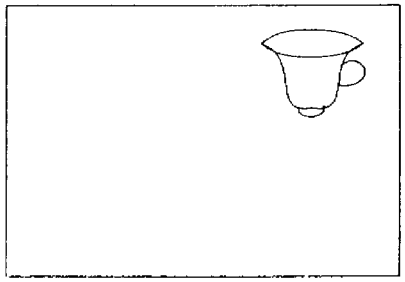
FIG. 11B is a view showing a displayed image corresponding to the input image shown in FIG. 11A.
Figure 12:
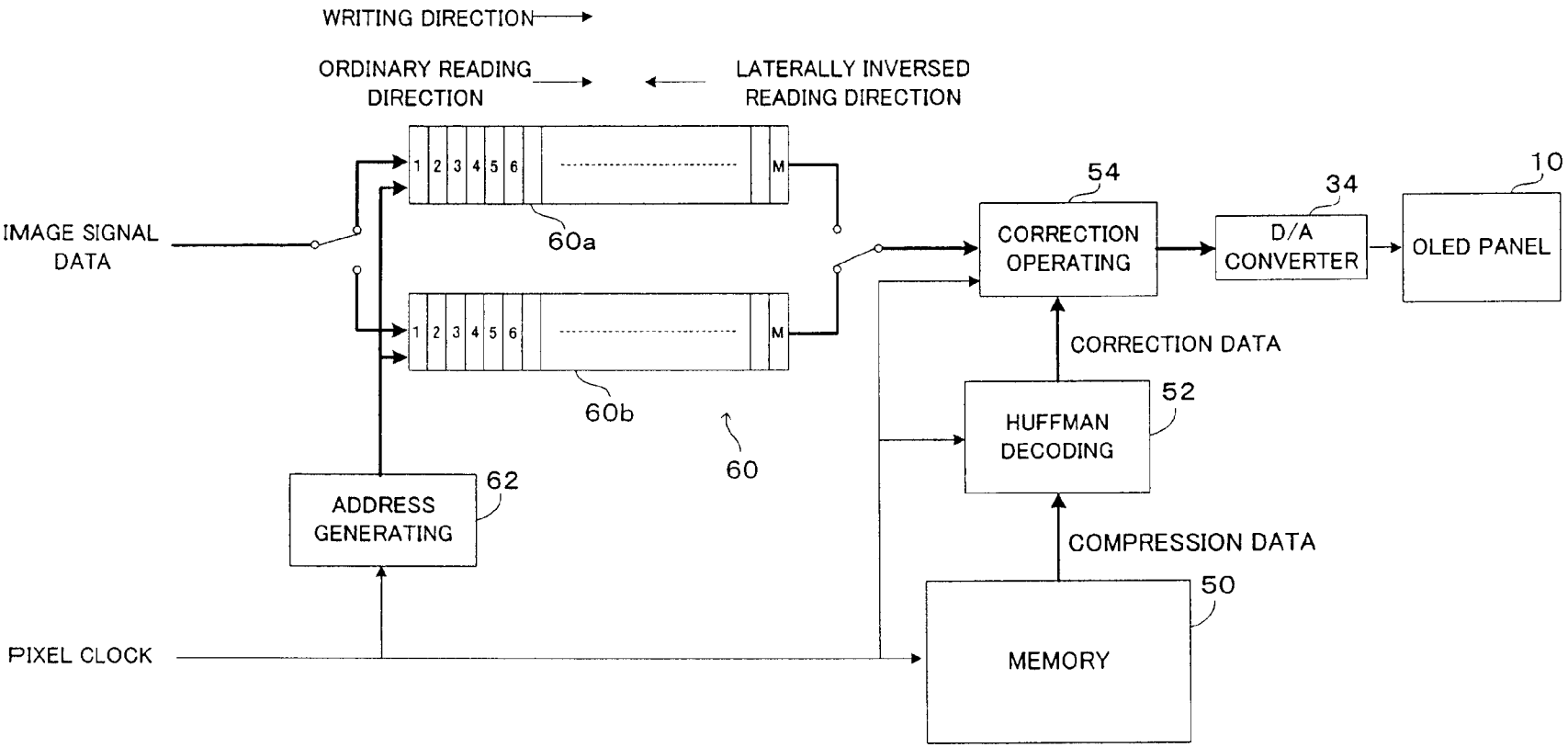
FIG. 12 is a block diagram showing an example of a circuit arrangement for displaying a laterally inversed image.

FIGS. 11A and 11B show two images inversed in the horizontal scanning direction. FIG. 12 is an arrangement of a display system that can realize such an inversed display.

The display system includes a buffer 60 that can successively hold, from the first address, image signal data of two horizontal lines. A buffer 60*a* can hold image signal data of an odd horizontal line, while a buffer 60*b* can hold image signal data of an even horizontal line. The image signal data of an even line (or odd line), when the image signal data of an odd line (or even line) is written, can be read out in the inverse order from an address being set in the buffer 60. The correction operating section 54 performs calculations based on readout image signal data and expanded correction data. An address generating section 62 can generate write addresses from the head to the bottom of the buffer 60 for the writing processing and generate read addresses from the bottom to the head of the buffer 60 for the reading processing.

The above processing can realize the inverse display of an image in the right and left direction without changing the drive timing of the panel, and can properly correct the irregularities. When an ordinary non-inverse image is displayed, the writing direction is equal to the reading direction.

Furthermore, instead of holding the input image data in the buffer and reading the data in the inverse order, it is possible to hold expanded correction values of 2 lines in the buffer and read the correction data in the inverse order from a line not being currently written and perform calculations based on the readout correction data and the input image data.

Figure 13A:
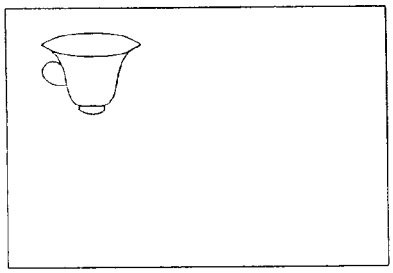
FIG. 13A is a view showing an example of an input image.
Figure 13B:
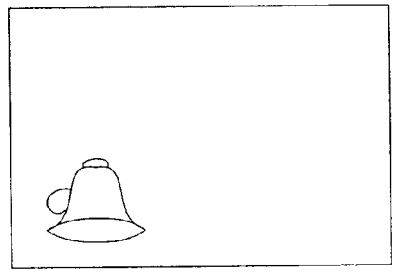
FIG. 13B is a view showing a displayed image corresponding to the input image shown in FIG. 13A.

FIGS. 13A and 13B shows two images inversed in the vertical scanning direction. To realize such an inverse display, the vertical scanning direction of the display panel is reversed and an arrangement shown in FIG. 14 can be used.

Figure 14:
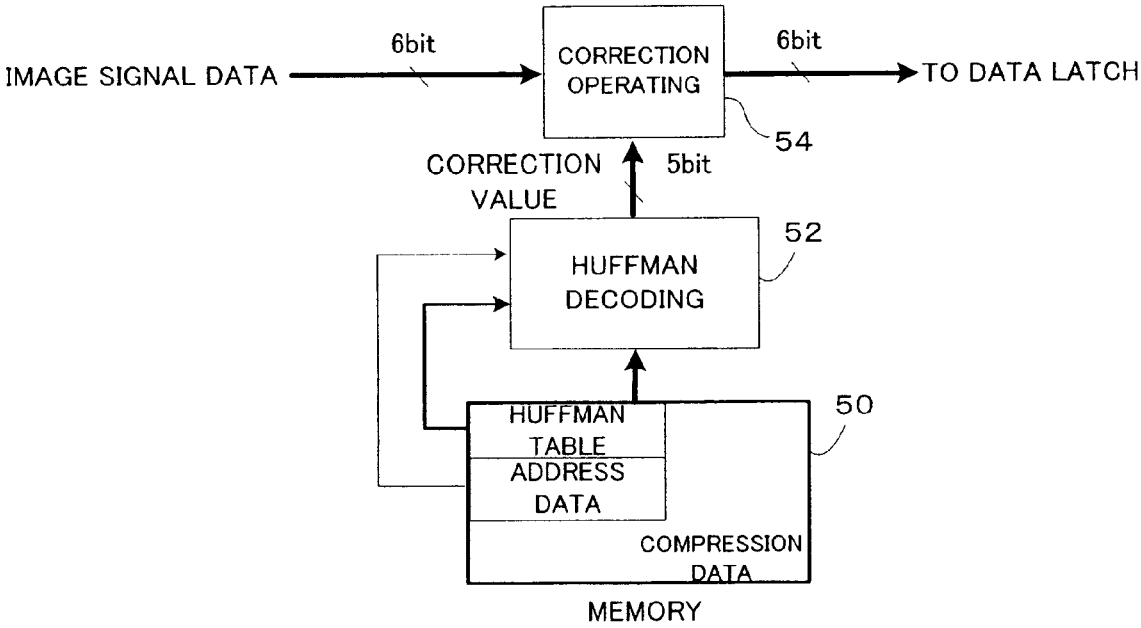
FIG. 14 is a block diagram showing another example of a circuit arrangement for correcting image signals.
Figure 15:
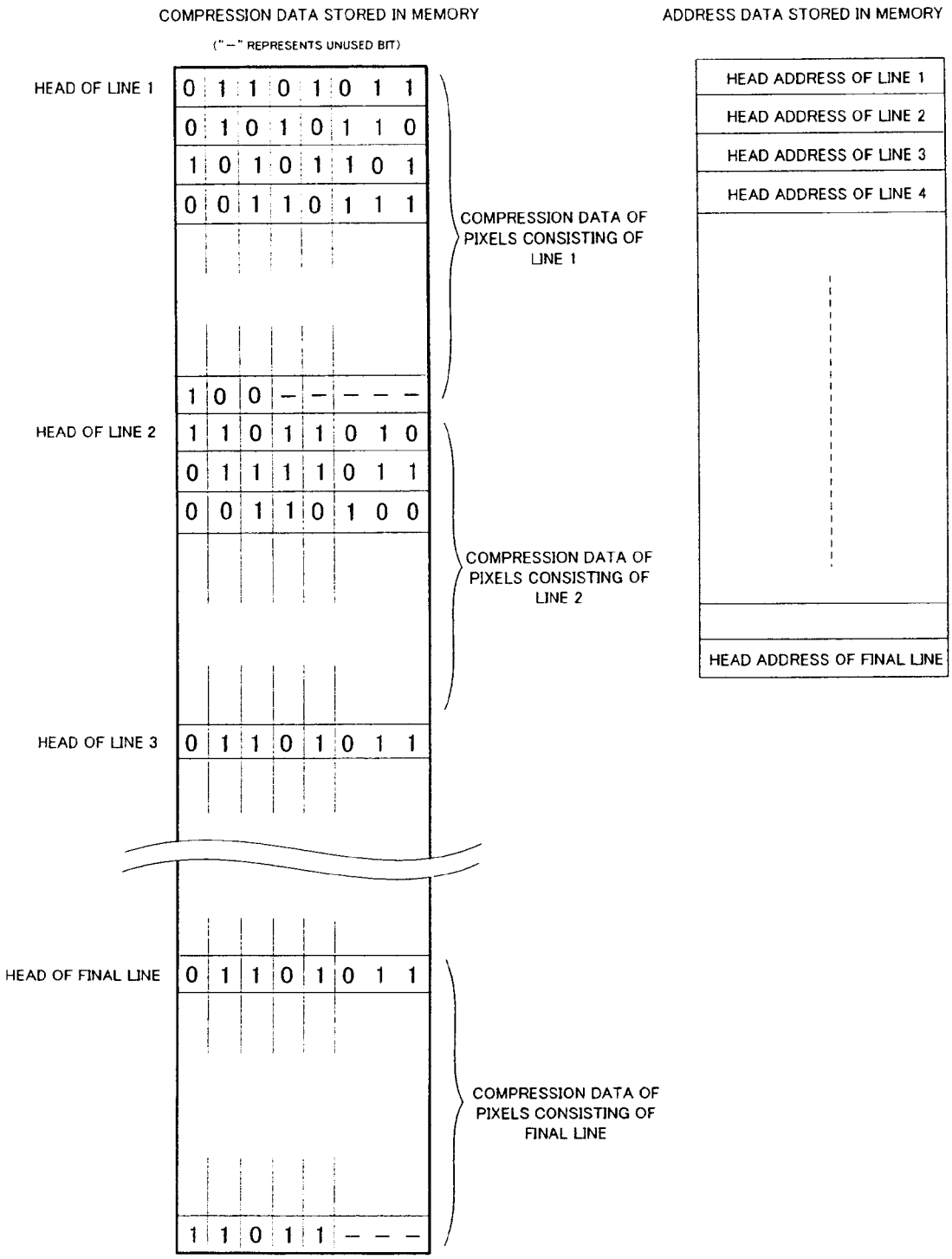
FIG. 15 is a view showing compression data and address data stored in a memory.

In FIG. 14, the memory 50 stores an address table showing a correction data storage position of a leading pixel of each horizontal line, in addition to the Huffman table and the compression data. The correction data can be expanded from the final line. The correction operating section 54 can perform calculations based on expanded correction data and the input image data of a corresponding pixel. FIG. 15 shows compression data disposed in such a manner that the address of a head of each line can be designated.

The minimum quantization step for the correction values need not be identical to the minimum quantization step for the image signal data. It is not always necessary to completely correct the irregularities, because thin and weak irregularities will not be visually recognized. Therefore, the quantization step for the correction values can be variably determined so that the use of a limited memory capacity can be optimized considering the Huffman compressed result.

Figure 16:
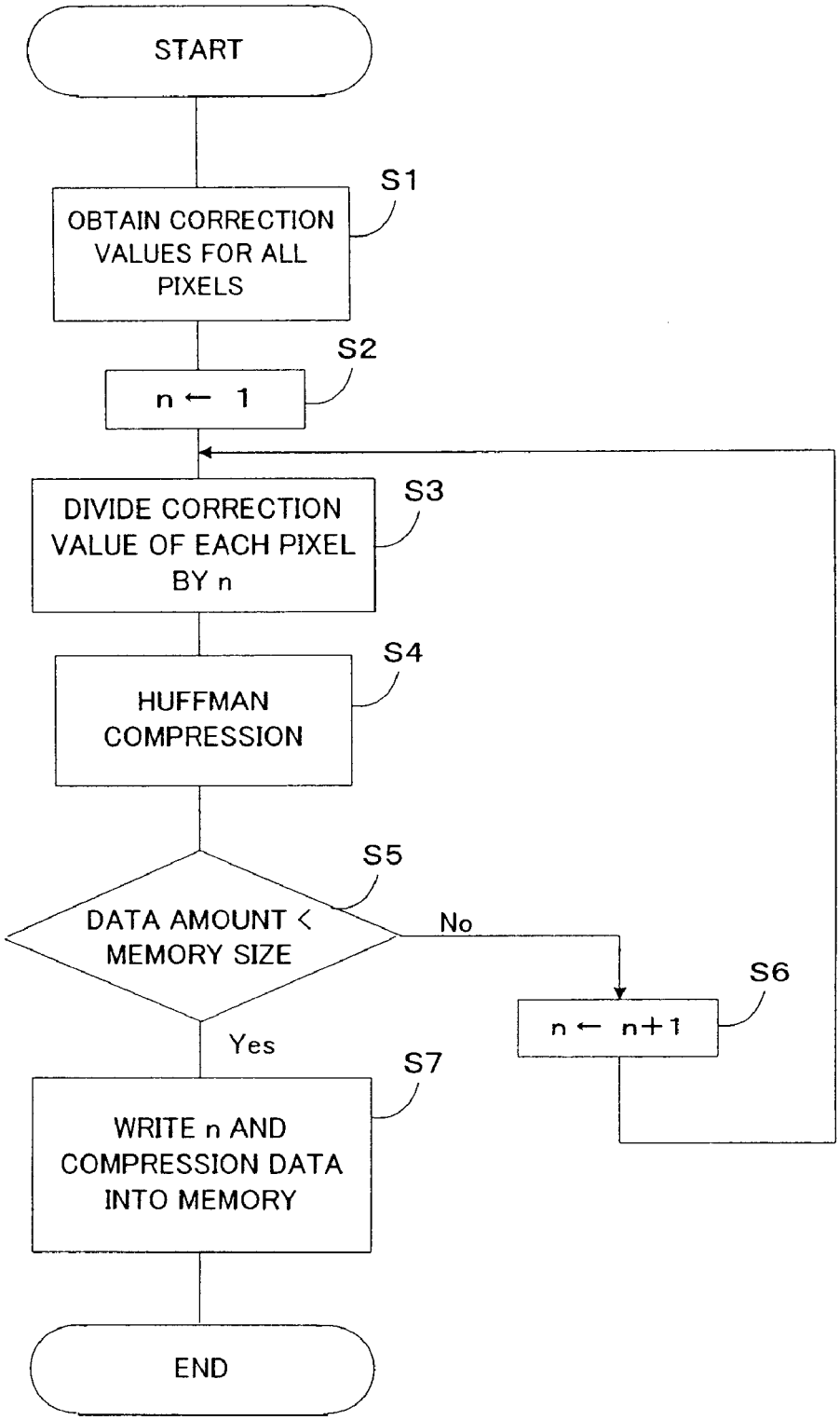
FIG. 16 is a flowchart showing the compression processing using a fixed Huffman table.

FIG. 16 is a flowchart showing the compression processing using a fixed Huffman table, including the steps of: obtaining correction values for all pixels (refer to step S1); designating n=1 (refer to step S2); dividing the correction value of each pixel by n (refer to step S3); and performing the Huffman compression (refer to step S4).

Furthermore, the compression processing includes the steps of: determining whether the data amount is less than a memory size (refer to step S5); if the judgment result of step S5 is NO, incrementing n by 1 (i.e., n=n+1, refer to step S6) and returning to the step S3; and if the judgment result of step S5 is YES, writing n and the compression data into the memory 50 (refer to step S7) and terminating the processing.

Figure 17:
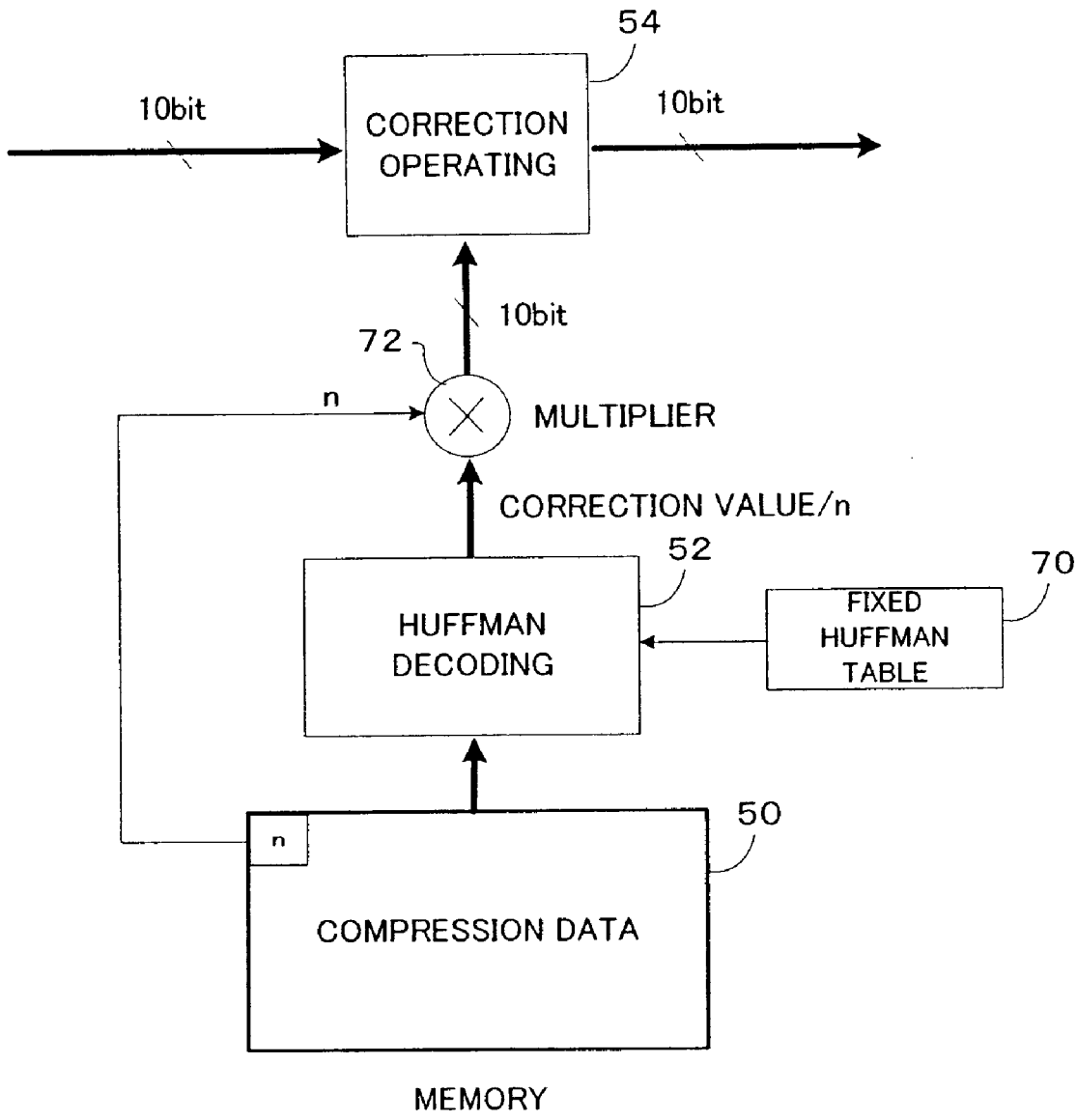
FIG. 17 is a block diagram showing another example of the correcting section.

FIG. 17 shows an arrangement for calculating correction values, including a memory 50, a Huffman decoding section 52, a correction operating section 54, a fixed Huffman table 70, and a multiplier 72. The memory 50 can store n values together with the compression data. The Huffman decoding section 52 can generate a correction value/n based on the compression data stored in the memory 50 as well as data obtained from the fixed Huffman table 70. The multiplier 72 can multiply the correction value/n sent from the Huffman decoding section 52 with an n value supplied from the memory 50 to produce a correction value. The correction operating section 54 can receive the correction value from the multiplier 72.

In this example, the input data and the correction data are both 10 bits, and the accuracy of correction data varies depending on the value of n. The value of n can be 2k (k is a positive integer) for the purpose of simplifying the hardware arrangement.

Figure 18:
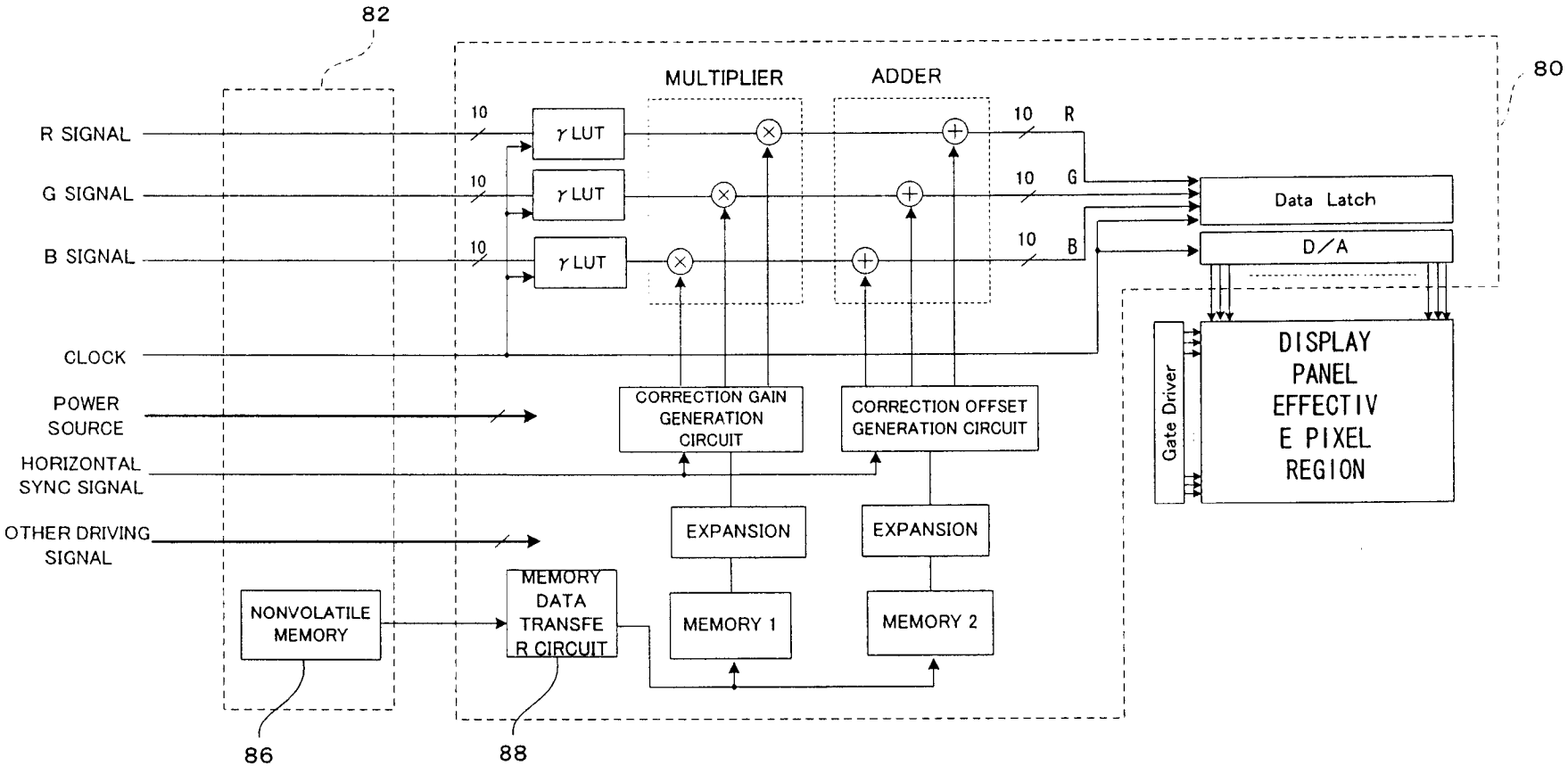
FIG. 18 is a block diagram showing another example of a circuit arrangement for correcting image signals, including a driver IC and a flexible cable.
Figure 19:
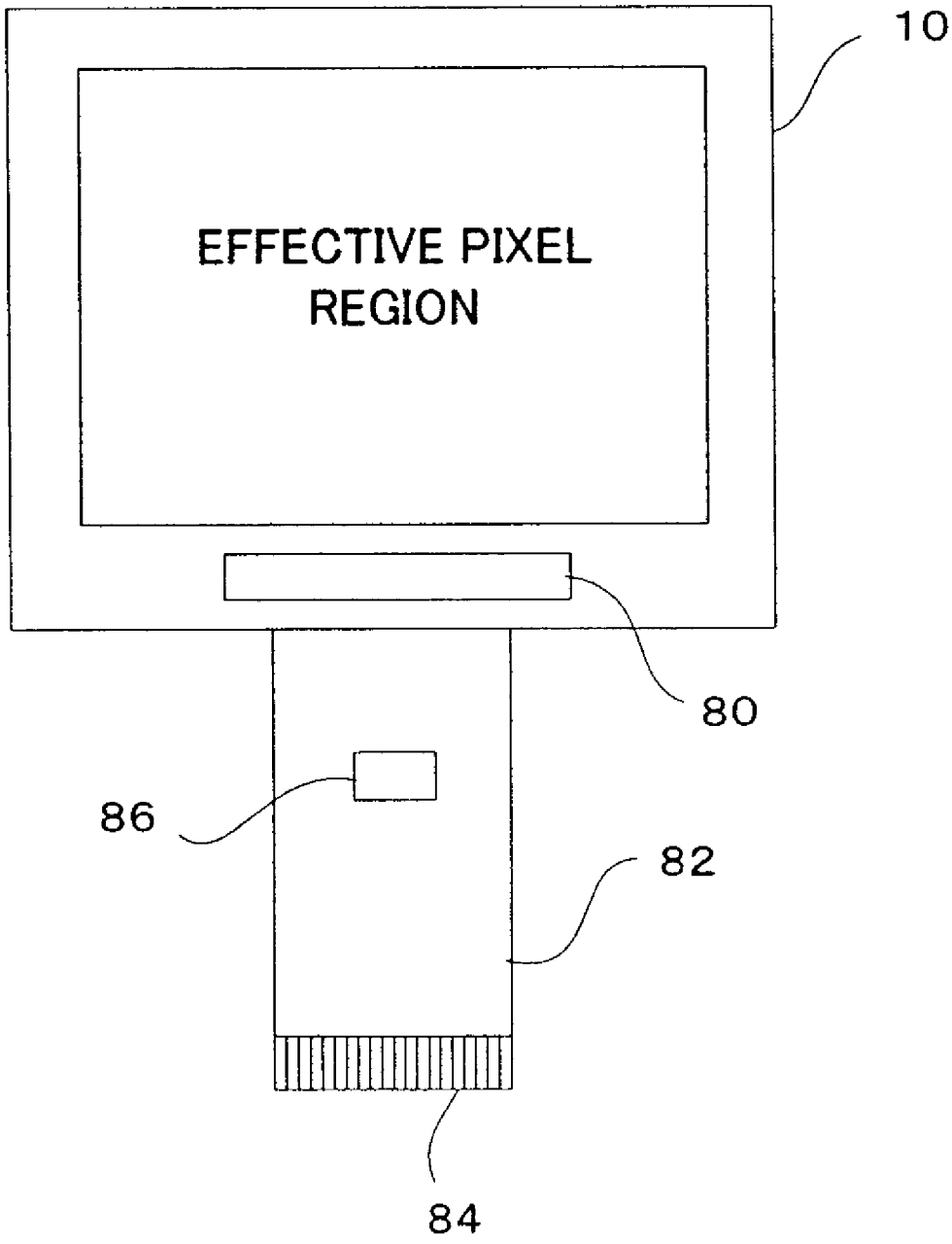
FIG. 19 is a view showing a practical example of the mounting structure for the driver IC and the flexible cable.
Figure 20:
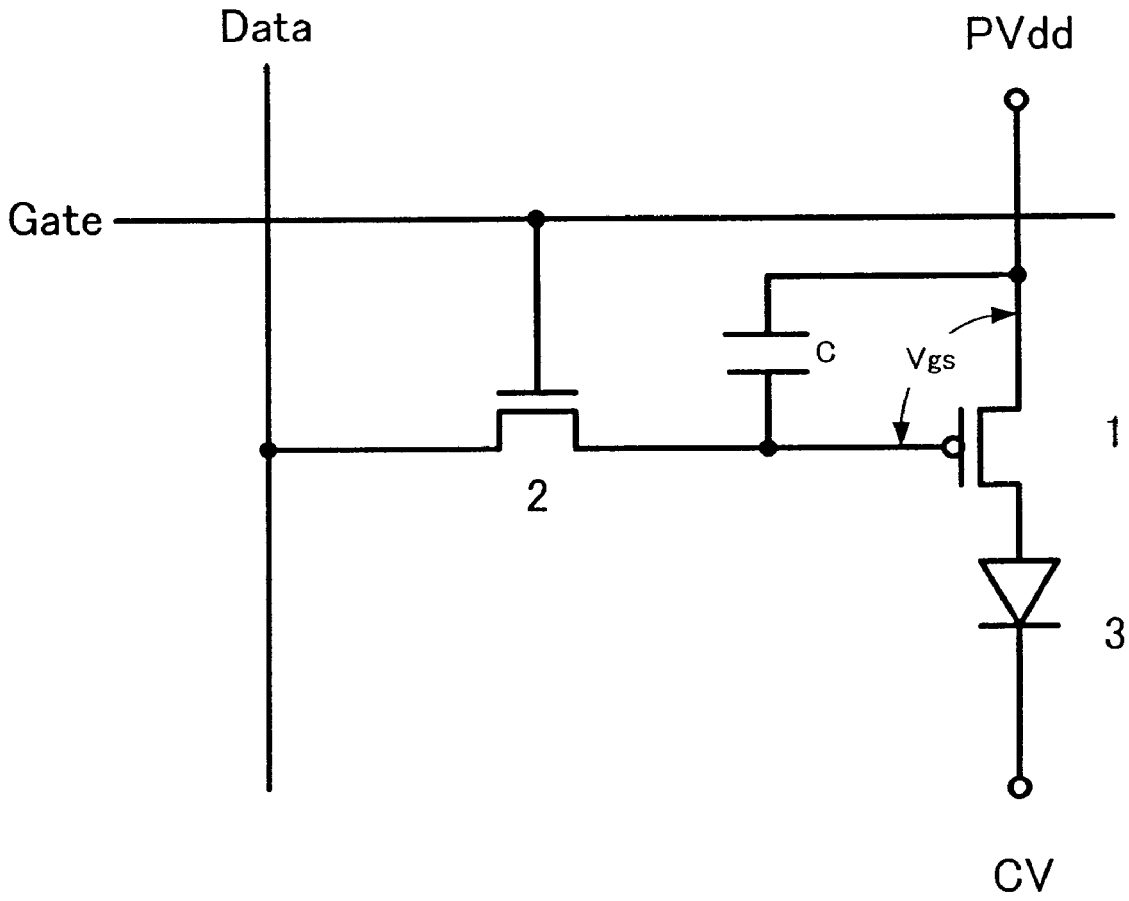
FIG. 20 is a prior art circuit diagram showing an arrangement (i.e., a pixel circuit) of one pixel in an active organic EL display apparatus.
Figure 21:
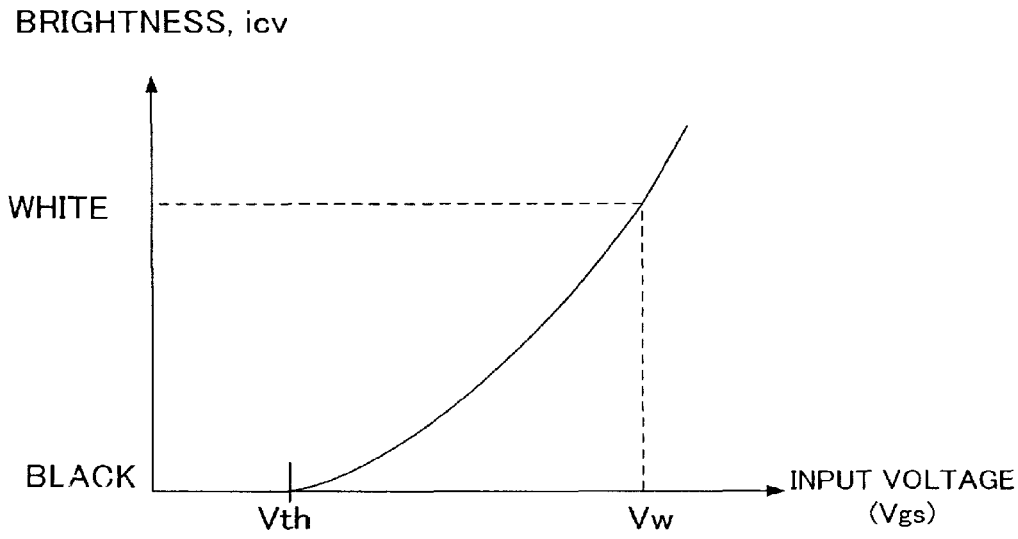
FIG. 21 is a graph showing a typical relationship between the input signal voltage of a driver TFT and the current flowing in an organic EL element of FIG. 20.

Furthermore, in the arrangement shown in FIG. 4, the memories 38 and 42 storing the compression data can be nonvolatile memories and the compression data can be written into the nonvolatile memories beforehand (for example, at the time of delivery of a panel). Furthermore, the memories 38 and 42 can be RAM if compression data can be loaded to the memories 38 and 42 from a separately provided nonvolatile memory in response to a turning-on of a power source of the display apparatus, as shown in FIG. 18. FIG. 19 shows a practical example of a nonvolatile memory 86 mounted on the display panel 10.

In FIG. 19, a driver IC 80 can include the look-up table LUT20 through the D/A converter 34. A flexible cable 82, having a connection terminal 84 at its distal end, is connected to the driver IC 80. The flexible cable 82 mounts the nonvolatile memory 86. Furthermore, the driver IC 80 can include a memory data transfer circuit 88. The memory data transfer circuit 88 is connected to the nonvolatile memory 86 on the flexible cable 82. When the electrical power is turned on, the memory data transfer circuit 88 can transfer the data stored in the nonvolatile memory 86 to the memories 38 and 42 of the driver IC 80.

The driver IC 80 is a COG (Chip On Glass), and the display panel 10 is placed on the glass. The nonvolatile memory 86 can be a flash memory.

As will be apparent from the foregoing description, the present embodiment can reduce the capacity of a memory required for correcting brightness irregularities. Furthermore, unless the compression data exceed a maximum capacity of a memory, a wide range of irregularities can be corrected.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

PARTS LIST

1 driver TFT
2 selection TFT
3 organic EL element
10 display panel
20 look up table
22 multipliers
24 correction gain generation circuit
28 adders
30 correction offset generation circuit
32 data latch circuit
34 D/A converter
36 expansion circuit
38 memory
40 expansion circuit
42 memory
50 memory
52 Huffman decoding section
54 correction operating section
56 streak correcting section
60 buffer
62 address generating section
70 fixed Huffman table
72 multiplier Parts List Cont'd

80 driver IC
82 flexible cable
84 connection terminal
86 nonvolatile memory
88 transfer circuit

The invention claimed is:

1. A display apparatus, comprising:

control means for controlling the display of pixels constituting a screen display based on input data, wherein the screen display has a plurality of small areas;

a correction memory storing correction data for eliminating unevenness in brightness among respective pixels, wherein the correction data includes (i) brightness irregularity correction data for each small area consisting of a plurality of pixels on the screen display and (ii) compression data calculated based on correction data of each pixel and the brightness irregularity correction data for each small area, wherein the compression data are entropy coded data; and correcting means for correcting brightness irregularities based on the data stored in the memory and the input data, wherein the correcting means is configured to expand the compression data and to calculate correction values based on (i) brightness irregularity correction data of at least one of the small areas stored in the correction memory and (ii) the expanded data, wherein the correcting means is configured to calculate correction values according to Equations (i) and (ii):

$$Zo(m,n)=zo(m,n)-xo(m)-yo(n),$$ Equation (i):

$$Zg(m,n)=zg(m,n)/(xg(m)\times yg(n)),$$ Equation (ii):

wherein Zo(m,n) represents residual offset correction data of the pixel positioned at coordinates (m,n), zo(m,n) represents offset correction data of the pixel, xo(m) represents an average of offset correction data obtained from the pixels aligned along a vertical line at a horizontal position m, yo(n) represents an average of offset correction data obtained from the pixel aligned along a horizontal line at a vertical position n, Zg(m,n) represents residual gain correction data of the pixel, zg(m,n) represents gain correction data of the pixel, xg(m) represents an average of gain correction data obtained from the pixels aligned along a vertical line at a horizontal position m, and yg(n) represents an average of gain correction data obtained from the pixels aligned along a horizontal line at a vertical position n, where m and n are integers greater than or equal to 1.

2. The display apparatus according to claim 1, wherein the entropy coded data are obtained by Huffman coding.

3. The display apparatus according to claim 2, wherein the correction memory stores Huffman tables differentiated for small areas.

4. The display apparatus according to claim 3, wherein the Huffman table is determined based on display characteristics of each pixel in the display apparatus.

5. The display apparatus according to claim 1 further comprising a buffer memory that is independent of the correction memory and can hold input data of two horizontal lines, wherein:

the input data are successively written into the buffer memory; and an image inversed in the lateral direction is displayed by reading the input data from a final pixel to a leading pixel in each line and performing calculations based on readout data and the correction data.

6. The display apparatus according to claim 5, wherein:

the correction memory stores correction data in such a manner that a correction data storage location for a leading pixel of each horizontal line can be identified; and the correcting means reverses a vertical scanning direction of a display panel, successively reads and expands compressed correction data from a final horizontal line to a leading horizontal line of the correction memory, and calculates the collection values based on the expanded data and the input data of a corresponding pixel read out of the buffer memory, thereby displaying an image inverse in both the lateral and vertical directions.

7. The display apparatus according to claim 1, wherein:

the correction memory stores correction data in such a manner that a correction data storage location of a leading pixel of each horizontal line can be identified; and the correcting means reverses a vertical scanning direction of a display panel, successively reads and expands compressed correction data from a final horizontal line to a leading horizontal line of the correction memory, and calculates the correction values based on the expanded data and the input data, thereby displaying an image inverse in the vertical direction.

8. The display apparatus according to claim 1, wherein each pixel has an organic EL element having light-emitting capability.

9. The display apparatus according to claim 1, wherein the correcting means is configured to further perform inverse calculation.

10. The display apparatus according to claim 9, wherein the inverse calculation is performed according to equations (iii) and (iv):

$$zo(m,n)=Zo(m,n)+xo(m)+yo(n),$$ Equation (iii):

$$zg(m,n)=Zg(m,n)\times xg(m)\times yg(n).$$ Equation (iv):

* * * * *